US007069626B2

(12) United States Patent
Issler

(10) Patent No.: US 7,069,626 B2
(45) Date of Patent: Jul. 4, 2006

(54) LACING SYSTEM

(75) Inventor: James E. Issler, Greenwich, CT (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 10/625,967

(22) Filed: Jul. 24, 2003

(65) Prior Publication Data

US 2005/0015948 A1 Jan. 27, 2005

(51) Int. Cl.
*A43C 7/00* (2006.01)

(52) U.S. Cl. ..... 24/714.6

(58) Field of Classification Search .... 24/714.8–715.2, 24/713.9–714.5, 714.6, 598.5, 598.6; 36/50.1
See application file for complete search history.

(56) References Cited

U.S. PATENT DOCUMENTS

| | | | | | |
|---|---|---|---|---|---|
| 449,273 | A * | 3/1891 | Raymond | 24/714.4 |
| 835,068 | A * | 11/1906 | Johnston | 24/714.8 |
| 876,341 | A * | 1/1908 | Forstner | 24/683 |
| 887,942 | A | 5/1908 | Houghland | |
| 888,454 | A * | 5/1908 | Almy | 24/714.1 |
| 991,443 | A | 5/1911 | Heath | |
| 1,548,407 | A * | 8/1925 | Chisholm | 24/714.9 |
| 1,995,243 | A | 3/1935 | Clarke | 24/140 |
| 2,913,793 | A * | 11/1959 | Tallarico | 24/713.9 |
| 3,038,171 | A | 6/1962 | Barolucci et al. | 4/172 |
| 3,197,833 | A * | 8/1965 | Puthuff | 36/54 |
| 4,507,878 | A | 4/1985 | Semouha | 36/50 |
| 5,109,581 | A * | 5/1992 | Gould | 24/714.6 |
| 5,347,695 | A | 9/1994 | Lopez Saiz | 24/714.8 |
| 5,379,496 | A * | 1/1995 | Krauss | 24/625 |
| 5,755,044 | A * | 5/1998 | Veylupek | 36/50.1 |
| 6,240,657 | B1 * | 6/2001 | Weber et al. | 36/50.1 |
| D462,162 | S | 9/2002 | Peng | D2/978 |
| 6,568,104 | B1 * | 5/2003 | Liu | 36/50.1 |

FOREIGN PATENT DOCUMENTS

WO WO 9740718 A1 * 11/1997

* cited by examiner

*Primary Examiner*—James R. Brittain
(74) *Attorney, Agent, or Firm*—St. Onge Steward Johnston & Reens LLC

(57) ABSTRACT

An improved lacing method and apparatus as provided, having a clasp with an anchoring end and a lace end, where the lace end is adapted to hold a lace. An anchoring end is also included having a first part and a second part where the first and second parts are movable away from and toward one another. The closing mechanism also has a receiver with a first receptacle and a second receptacle for engaging the first and second parts, respectively, and wherein the clasp is removably joinable to the receiver when the first and second parts are engaged with the first and second receptacles and, when the first and second parts are disengaged with the first and second receptacles, the clasp is separable from the receiver.

6 Claims, 4 Drawing Sheets

LACING SYSTEM

FIELD OF THE INVENTION

The invention relates to an improved lacing system for closing any shoe, luggage, bag, or compartment where laces, zippers, or other closing mechanisms are conventionally used.

BACKGROUND OF THE INVENTION

Footwear, luggage, back packs, garment bags, brief cases, and other items that are typically opened and closed often employ closing mechanisms such as zippers, buttons, clasps, ties, or other similar closing devices.

In an item that typically employs laces or ties, opening and closing the item would usually involve tying and untying the laces or ties each time the item was opened or closed. This repetition is often exacerbated should the item to be closed be tied or laced too tightly or too loosely, which often results in untying and retying the laces or ties to the proper fit. Moreover, tying and retying an item each time it was to be opened or closed generally involved a lengthy period of time.

For other items to be opened and closed, buttons may be used instead of laces or ties. Although buttons may reduce or eliminate the occurrence of the item being closed too tightly or too loosely, the time spent to button and unbutton the item was often as lengthy or more lengthy than the time spent to lace and unlace an item. In some situations, buttoning the item took longer than tying it because there may be multiple buttons where a single lace or tie may be used in its place. Moreover, buttons may be accidentally broken or lost and difficult to replace as it usually entails sewing the buttons on one at a time. On the other hand, laces or ties are often less prone to breakage and replacing a lace is generally easier than sewing multiple buttons in place.

Zippers are another type of closing mechanism that may be used in place of buttons or laces. Zippers tend to allow easier and quicker closing and/or opening of an item over laces, ties, or buttons. Although zippers are generally sturdy, once broken, zippers tend to be difficult to replace as sewing is generally needed. Moreover, based on the toughness and thickness of a zipper together with the item, sewing a zipper may also entail use of a sewing machine, which may present a problem if a sewing machine is not available.

The Clarke (U.S. Pat. No. 1,995,243), Heath (U.S. Pat. No. 991,443), Peng (U.S. Pat. No. 462,162), and Houghland (U.S. Pat. No. 887,942) patents typically involve the use of laces or ties. Opening and closing the items appear to require the laces or ties to be tied and untied each time the shoe is to be worn or removed.

The Semouha (U.S. Pat. No. 4,507,878) patent also appears to use laces or ties to open and close a shoe. Although the laces do not appear to be tied or untied each time the shoe is to be worn or removed, the laces seem to be slid downward toward the ankle area of the shoe. In this position, a user's foot may be slipped in and out of the shoe, which may prove uncomfortable since the foot is squeezed each time it passes through the ankle area of the shoe. This problem may be even more troublesome should a user's foot be large or should the user have difficulty maneuvering his/her foot through what is believed to be a generally tight channel.

The Lopez Saiz (U.S. Pat. No. 5,347,695) patent seems to relate to a device that facilitates repeated opening and closing of a shoe. However, the device appears to be easily dislodged from the shoe and, therefore, may permit the shoe to be accidentally untied or opened.

What is desired, therefore, is a closing mechanism that permits repetitive opening and closing of an item. Another desire is a closing mechanism that permits faster opening and closing of an item over conventional closing mechanisms. A further desire is a closing mechanism that resists breakage and, if breakage should occur, is easy to replace onto the item.

SUMMARY OF THE INVENTION

Accordingly, it is an object of the invention to provide a closing mechanism that facilitates opening and closing of an item.

It is another object of the invention to provide a closing mechanism that consistently opens and closes an item with improved repeatability.

It is another object of the invention to provide a closing mechanism with low cost and that is easily replaced.

These and other objects of the invention are achieved by an improved lacing system having a clasp with an anchoring end and a lace end, where the lace end is adapted to hold a lace. An anchoring end is also included having a first part and a second part where the first and second parts are movable away from and toward one another. The closing mechanism also has a receiver with a first receptacle and a second receptacle for engaging the first and second parts, respectively, and wherein the clasp is removably joinable to the receiver when the first and second parts are engaged with the first and second receptacles and, when the first and second parts are disengaged with the first and second receptacles, the clasp is separable from the receiver.

The lace end may also include a holder for holding the lace. In some embodiments, the holder is a hook or loop. The receiver may also include a cylinder or a shaft with bored ends.

When an optional opening force is applied to the clasp, the first and second parts move away from one another. When the optional opening force is removed, the first and second parts automatically move toward one another due to a biasing force that biases the first and second parts toward one another.

In some embodiments, the receiver is secured to a side of an aperture of an item to be closed. In other embodiments, the receiver is secured to an eyelet of an item to be closed.

In another aspect of the invention, a method is provided for improving the lacing system, including the steps of providing a clasp having a receiver end and a lace end. The method also includes extending a first part and a second part from the receiver end and extending a holder from the lace end. The method further includes the step of providing a receiver having a first receptacle and a second receptacle for receiving the first and second parts, respectively, and wherein the clasp is removably joinable to the receiver for closing an item and the clasp is separable from the receiver for opening the item.

In further embodiments, the method may include engaging the first and second parts with the first and second receptacles, respectively, for removably joining the clasp and receiver together. In some of these embodiments, the method may include the step of disengaging the first and second parts from the first and second receptacles, respectively, for separating the clasp from the receiver.

In selected embodiments, the method may move the first and second parts toward one another and into the first and second receptacles, respectively, to removably join the clasp with the receiver. In some of these selected embodiments, the method may move the first and second parts away from one another and out of the first and second receptacles, respectively, to separate the clasp from the receiver.

Optionally, the method secure the receiver to a side of an aperture of an item to be closed. In addition, the method may secure the receiver to an eyelet. Moreover, the method may pass a lace through the holder.

The invention and its particular features and advantages will become more apparent from the following detailed description considered with reference to the accompanying drawings.

DETAILED DESCRIPTION OF THE DRAWINGS

Figure 1:
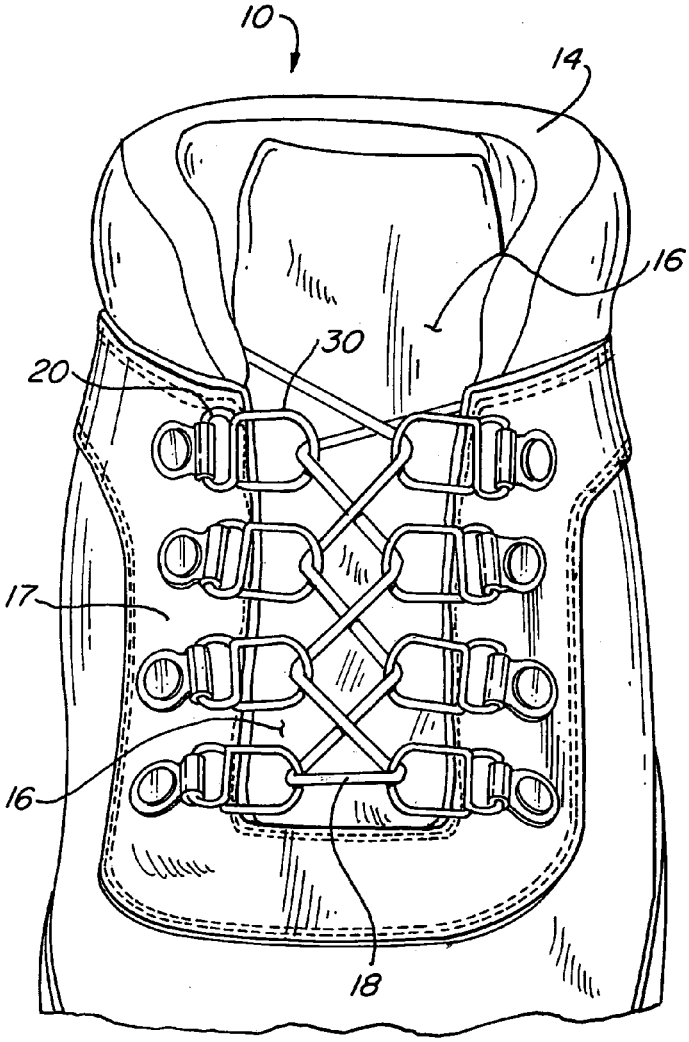
FIG. 1 depicts the improved lacing system in accordance with the invention.

FIG. 1 depicts the improved lacing system 10 in accordance with the invention. Lacing system 10 includes receiver 20 and clasp 30, where receiver 20 and clasp 30 operate in cooperation with one another for opening and closing item 14. Due to the size of aperture 16, multiple receivers 20 and clasps 30 may be used. For a small aperture, as few as one receiver and one clasp may be used. The quantity of receivers and clasps should be a limitation of the invention. Receiver 20 and clasp 30 further facilitate repetitive opening and closing, while reducing the time spent opening and closing, item 14. Moreover, receiver 20 and clasp 30 permit a user to repeatedly close item 14 with the same or similar degree of tension in lace 18, which is particularly beneficial if item 14 is a shoe, article of clothing, or other apparatus where proper and consistent fit are desired.

As shown, receiver 20 is secured to a side 17 of an aperture 16 of item 14 and, to close aperture 16, clasp 30 and, therefore, lace 18 are joined to receiver 20. Releasing clasp 30 from receiver 20 opens aperture 16. By releasing clasp 30 from receiver 20, lace 18 is also removed without necessitating that lace 18 be untied or removed from clasp 30. Therefore, rejoining clasp 30 to receiver 20 not only closes aperture 16 but provides consistent tension to lace 18 after clasp 30 is joined to receiver 20. Hence, the invention facilitates opening and closing aperture 16 while providing consistent, or repeatable, tension to lace 18 and obviating the occurrence of item 14 being closed too tight or loose.

Figure 2A:
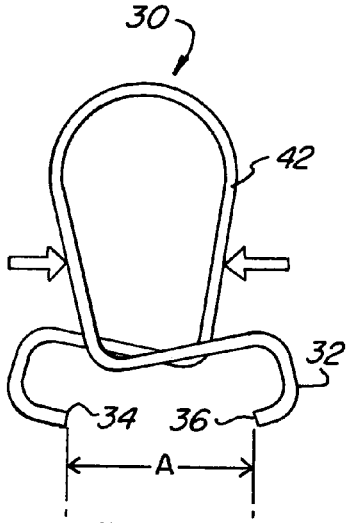
FIG. 2*a* depicts a top view of a clasp in the open position.
Figure 2B:
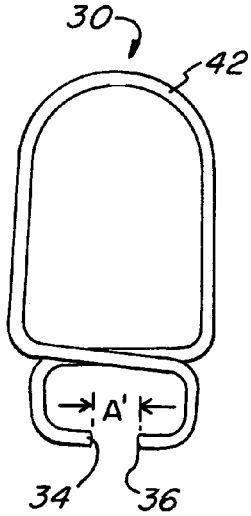
FIG. 2*b* depicts a top view of a clasp in the closed position.

FIGS. 2*a* and 2*b* more particularly depict clasp 30 in accordance with the invention. FIG. 2*a* shows clasp 30 in the open position and FIG. 2*b* shows clasp 30 in its original, resting position. FIG. 2*a* shows first part 34 and second part 36 of anchoring end 32 being moved away from one another by an opening force being applied to lace end 42, as shown. Upon lace end 42 being compressed, first and second parts 34, 36 are moved away from one another. For exemplary purposes, first and second parts 34, 36 are shown separated from one another at a distance A.

Clasp 30 is made of a material having an elastic characteristic so that, when the opening force is removed, clasp 30 and lace end 42, which is an elastically compressible loop return to its original shape, shown in FIG. 2*b*, which is also the closed position of clasp 30. Upon removal of the opening force, lace end 42 expands from its compressed position shown in FIG. 2*a* and, as a result, first part 34 and second part 36 also return to their original shape by moving toward one another. First and second parts 34, 36 automatically move toward one another upon the opening force being removed and automatically stop at distance A'. As can be seen, distance A is greater than distance A' and both distances may be any arbitrarily picked number. All that is required is that distance A be greater than receiver length L and distance A' be smaller than receiver length L so that clasp 30 may be engaged and disengaged with receiver 20. The distances A, A' in relation to length L are described in more detail below.

The material for clasp 30 may be any material that permits first and second parts 34, 36 to be moved away from one another upon a compressive force being applied to lace end 42 and having sufficient elasticity so that, when the compressive force is removed from lace end 42, first and second parts 34, 36 automatically move toward one another. For exemplary purposes, stainless steel, steel, plastic, fiberglass, and combinations thereof are just some possibilities of the material of clasp 30.

Figure 6A:
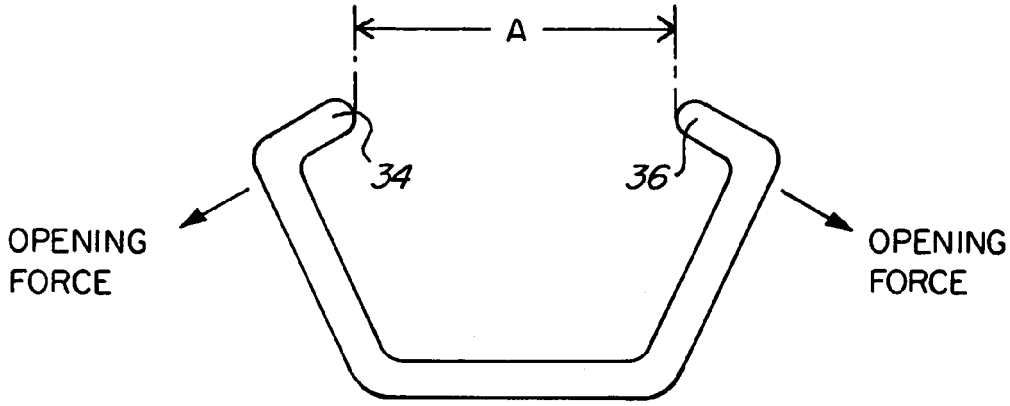
FIG. 6*a* depicts another embodiment of the clasp in the open position.
Figure 6B:
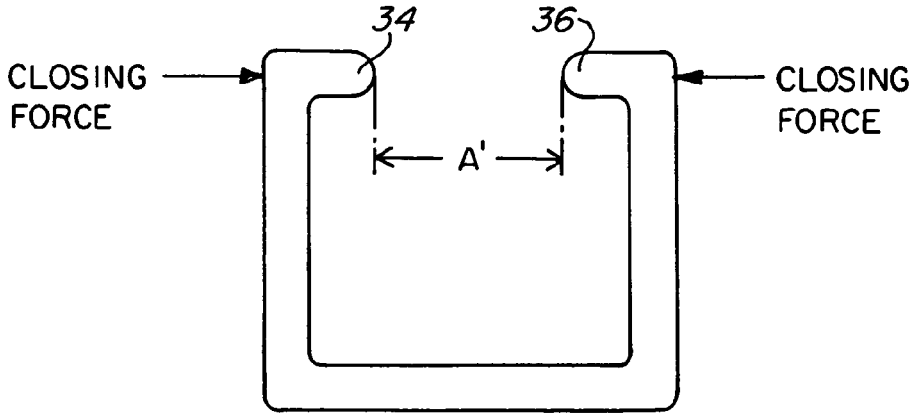
FIG. 6*b* depicts another embodiment of the clasp in the closed position.

In another embodiment of clasp 30, shown in FIG. 6*a* the material is not elastic but is permanently deformed each time first and second parts 34, 36 are either moved away from or toward one another. In this embodiment, when first and second parts 34, 36 are moved away from one another to the position shown in FIG. 2*a* and by an opening force, first and second parts 34, 36 remain in this position even when the opening force is removed. Hence, first and second parts 34, 36 do not automatically move back toward one another, as described under FIGS. 2*a* and 2*b*. A closing force, shown in FIG. 6*b*, will be used to move first and second parts 34, 36 toward one another.

In this embodiment, first and second parts 34, 36 open and close to engage and disengage from receiver 20 but, because of the non elastic nature of the material of clasp 30, various other geometries of clasp 30 may be employed that may be easier or less expensive than the embodiment of FIGS. 2*a* and 2*b*.

Figure 3A:
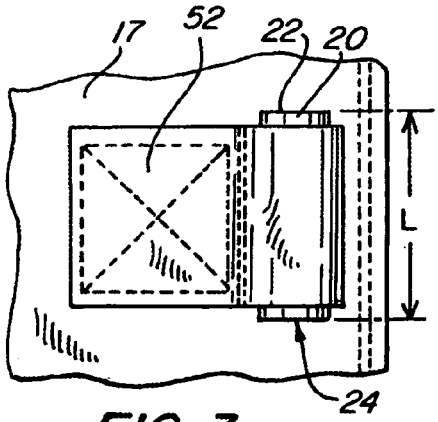
FIG. 3*a* depicts a top view of a receiver.
Figure 3B:
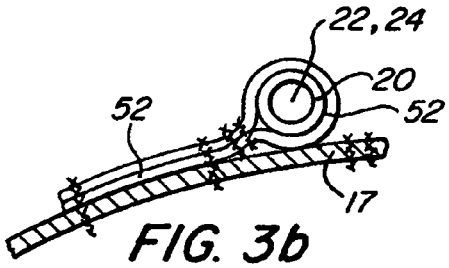
FIG. 3*b* depicts a side view of a receiver.

FIGS. 3*a* and 3*b* show a top view and side view, respectively, of receiver 20. As shown, receiver 20 is a cylinder having open ends that act as first and second receptacles 22, 24 for receiving first and second parts 34, 36, respectively. Once first and second parts 34, 36 are engaged with, or received into, first and second receptacles, clasp 30 is joined or secured, albeit removably joined or secured, to receiver 20. As shown, receiver 20 has a length L and for clasp 30 to be removably joined to receiver 20, first and second parts 34, 36 are moved away from one another at a distance A, where distance A is greater than length L. Clasp 30 is then moved so that receiver 20 is between first and second parts 34, 36 and then first and second parts 34, 36 are moved toward one another to the closed position, whether automatically as in FIG. 2*b* or by the manual closing force of FIG. 6*b*. In the closed position, shown in FIG. 2*b* or FIG. 6*b*, first and second parts 34, 36 are separated by a distance A', where A' is smaller than length L, and results in first and second parts 34, 36 being engaged with, or received into, first and second receptacles 22, 24. To disengage clasp 30 from receiver 20, first and second parts 34, 36 are moved away from one another and clasp 30 is moved away from receiver 20.

In another embodiment of receiver 20, receiver 20 is a solid shaft with bored ends. In further embodiments, receiver 20 is a hollow cylinder, which obviates the need to bore the ends of receiver 20 to provide first and second receptacles 22, 24. All that is required is receiver 20 have open ends to engage or receive first and second parts 34, 36.

Receiver 20 is attached to item 14 in any of the following possible embodiments. As shown, receiver 20 is glued to strap 52, which is sewn to side 17 of aperture 16. In addition or instead of being glued to strap 52, receiver may be sewn to strap. Receiver 20 may optionally be flanged at the opposite ends to help prevent receiver 20 from sliding out of pocket 54 of strap 52.

Figure 4A:
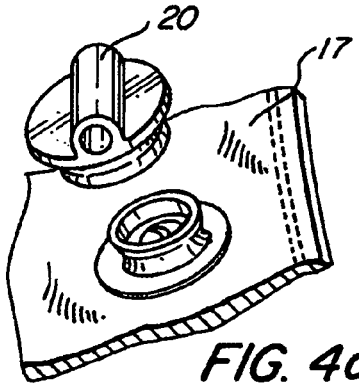
FIGS. 4*a*–4*d* depict various embodiments of attaching a receiver to the items to be repeatedly opened and closed.

In another embodiment, shown in FIG. 4*a*, receiver 20 is attached to a button half, which mates with a mating button half located on side 17 of aperture 16. In this embodiment, receiver 20 is removably joined to item 14. FIG. 4*d* shows a variation of the receiver shown in FIG. 4*a* where receiver 20 is attached to one side of the button half.

Figure 4B:
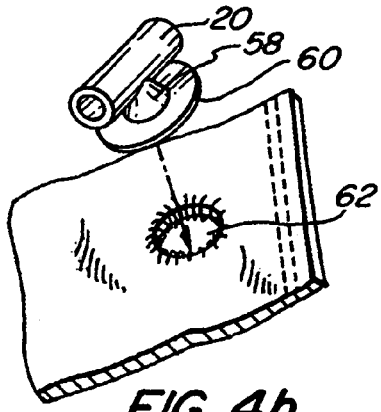
Figure 4D:
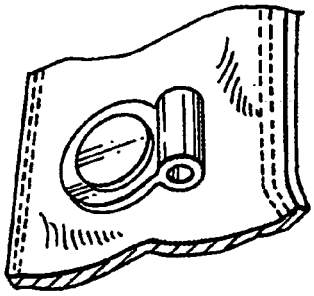

FIG. 4*b* shows yet another embodiment of attaching receiver 20 to item 14 where receiver 20 is attached to or integrally formed with protrusion 58. Protrusion 58 is inserted into eyelet 62, or other opening, of item 14. The mushroom shaped head 60 of protrusion 58 helps maintain protrusion 58 in eyelet 62. In this embodiment, receiver 20 is also removably joined to item 14 by merely inserting and pulling protrusion 58 in and out of eyelet 62.

Figure 4C:
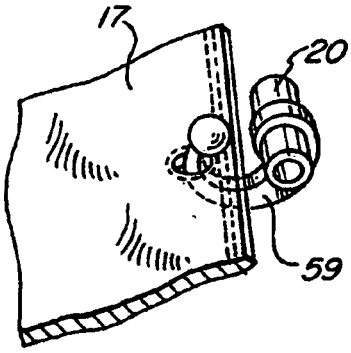

In another embodiment, shown in FIG. 4*c*, receiver 20 is attached to or integrally formed with a protrusion 59 and protrusion 59 is hook-shaped. Protrusion 59 is insertable into eyelet 62 and the hook-shaped geometry helps prevent protrusion 59 from accidentally being removed from eyelet 16. In this embodiment, receiver 20 is also removably joined to item 14.

Item 14 may be any article that can be opened and closed by clasp 30 in cooperation with receiver 20. The following is a non-exhaustive list of possibilities for item 14 that may employ the invention. It is understood that the invention is not limited to the items on this list and that item 14 is not a limitation of the receiver 20 or clasp 30, or variations of the receiver 20 or clasp 30 that would be obvious or known to one skilled in the art. The non-exhaustive list of possibilities for item 14 include a shoe, a bag, a compartment, a box, a suitcase, a jacket, a shirt, a pair of pants, a sweater, any article of clothing, and the like. The invention is applicable to any of the above possibilities in place of a button, zipper, lace, or tie.

Figure 5:
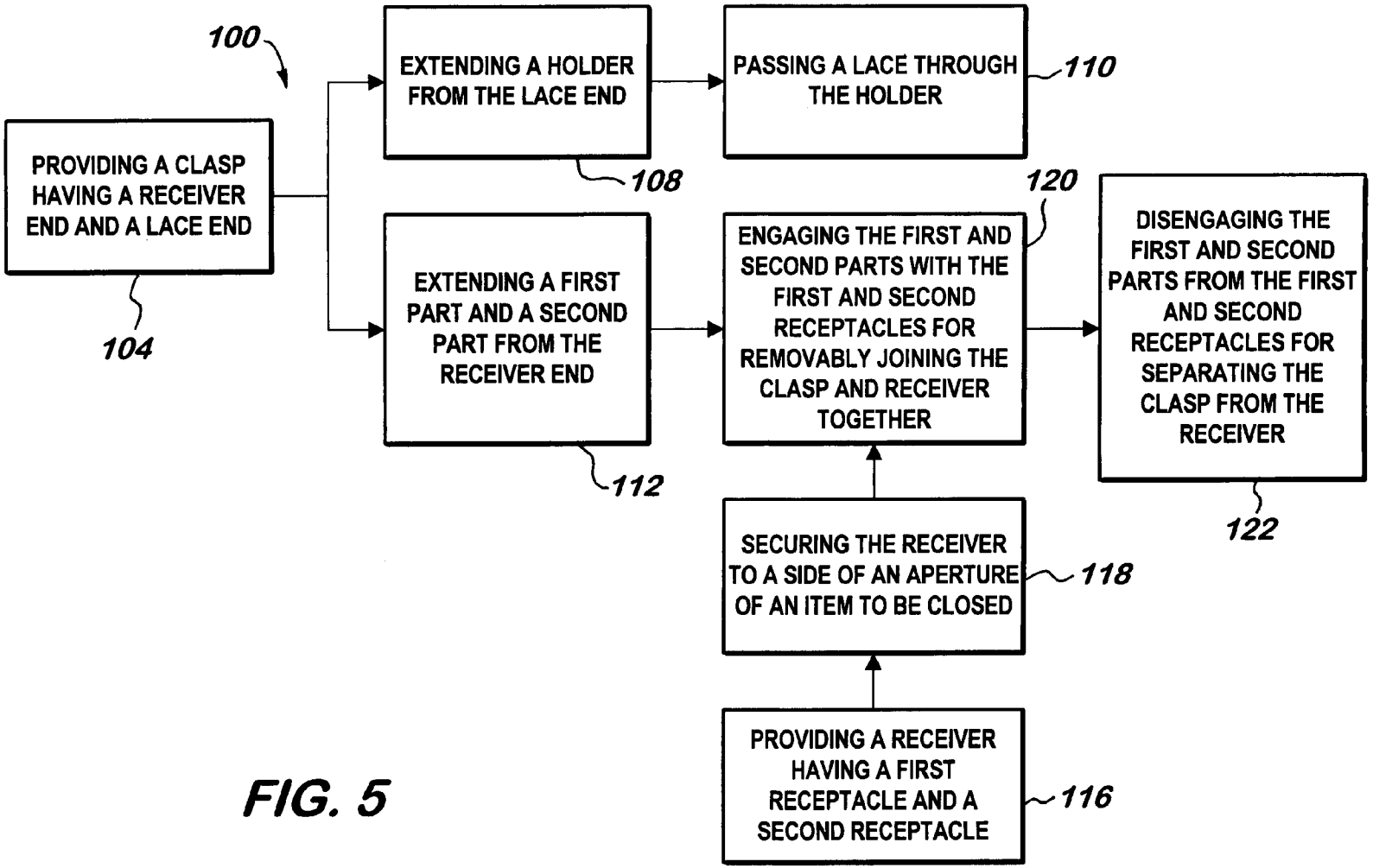
FIG. 5 depicts a method for providing the improved lacing system.

FIG. 5 depicts a method 100 for providing the improved lacing system, including the steps of providing 104 a clasp having a receiver end and a lace end, extending 108 a holder from the lace end for holding a shoe lace, and passing 110 a shoe lace through the holder.

Independent from the step of extending 108 a holder from the lace end, method 100 further includes the step of extending 112 a first part and a second part from the receiver end. Method 100 also provides 116 a receiver having a first receptacle and a second receptacle and secures 118 the receiver to a side of an aperture of an item that is to be opened and/or closed.

To close the item, method 100 engages 120 the first and second parts with the first and second receptacles for removably joining the clasp and receiver together. To open the item, method 100 disengages 122 the first and second parts from the first and second receptacles for separating the clasp from the receiver.

Although the invention has been described with reference to a particular arrangements of parts, features and the like, these are not intended to exhaust all possible arrangements or features, and indeed many other modifications and variations will be ascertainable to those of skill in the art.

What is claimed is:

1. A shoe having an improved lacing system comprising:
a shoe;
a clasp having an anchoring end and a lace end, said lace end adapted to hold a lace of the shoe;
said anchoring end having a first part and a second part where said first and second parts are movable away from and toward one another;
a receiver having a first receptacle and a second receptacle for engaging said first and second parts, respectively;
said receiver includes a removably attachable mechanism selected from the group consisting of a button or hook;
wherein said clasp is removably joinable to said receiver when said first and second parts are engaged with said first and second receptacles and, when said first and second parts are disengaged with said first and second receptacles, said clasp is separable from said receiver;
wherein said first and second parts are, when an opening force is applied to said clasp, moved away from one another; and
wherein said receiver is removably attached to said shoe by the removably attachable mechanism.

2. The lacing system according to claim 1, wherein said first and second parts are biased toward one another such that, when the opening force is removed, said first and second parts automatically move toward one another.

3. A method for providing a shoe with an improved lacing system, comprising the steps of:
providing a shoe;
providing a clasp having a receiver end and a lace end;
extending a first part and a second part from the receiver end;
extending a holder from the lace end;
providing a receiver having a first receptacle and a second receptacle for receiving the first and second parts, respectively, wherein the receiver includes a removably attachable mechanism selected from the group consisting of a button or hook;
remobably attaching the receiver to the shoe by the removably attachable mechanism;
moving the first and second parts toward one another and into the first and second receptacles, respectively, to removably join the clasp with the receiver; and
wherein the clasp is removably joinable to the receiver for closing an item and the clasp is separable from the receiver for opening the item.

4. The method according to claim 3, further comprising the step of moving the first and second parts away from one another and out of the first and second receptacles, respectively, to separate the clasp from the receiver.

5. The lacing system according to claim 1, wherein said button is a snap button.

6. The lacing system according to claim 1, wherein said button is insertable.

* * * * *